United States Patent [19]

Tanaka et al.

[11] 4,082,397

[45] Apr. 4, 1978

[54] HERMAPHRODITE HOUSING ASSEMBLY

[75] Inventors: Michiaki Tanaka, Sagamihara; Yoshimasa Nonaka, Musashino, both of Japan

[73] Assignee: Kabushiki Kaisha Elco International, Yokohama, Japan

[21] Appl. No.: 772,060

[22] Filed: Feb. 25, 1977

[30] Foreign Application Priority Data

Sep. 21, 1976 Japan ..... 51-112499

[51] Int. Cl.[2] ..... H01R 25/02

[52] U.S. Cl. ..... 339/49 R

[58] Field of Search ..... 339/47 R, 47 C, 49 R, 339/186 R, 186 M

[56] References Cited

U.S. PATENT DOCUMENTS

| | | | |
|---|---|---|---|
| 2,386,177 | 10/1945 | Andersen | 339/49 R |
| 3,299,493 | 1/1967 | Gehrt | 339/49 R |
| 3,440,596 | 4/1969 | Frompovicz | 339/49 R |
| 3,676,833 | 7/1972 | Johnson | 339/49 R |

FOREIGN PATENT DOCUMENTS

| | | | |
|---|---|---|---|
| 2,519,556 | 11/1975 | Germany | 339/186 M |
| 791,913 | 3/1958 | United Kingdom | 339/47 R |

OTHER PUBLICATIONS

Cinch Connector, Advertisement in Electronic Design, p. 74, 3/1964.

*Primary Examiner*—Neil Abrams

*Attorney, Agent, or Firm*—Kenneth E. Merklen; Thomas E. Harrison, Jr.

[57] ABSTRACT

A hermaphrodite housing assembly containing a plurality of positions for supporting a plurality of electrical connectors, secured captively in respective halves of the assembly for mating contacts positioned in opposite portions of the assembly.

3 Claims, 4 Drawing Figures

HERMAPHRODITE HOUSING ASSEMBLY

PRIORITY

A prior filing date of Sept. 21, 1976 is claimed for this application, under 35 U.S.C. 119, based on application Ser. No. 112499/1976 filed in the Patent Office of Japan on Sept. 21, 1976.

DETAILED DESCRIPTION OF THE INVENTION

Figure 1:
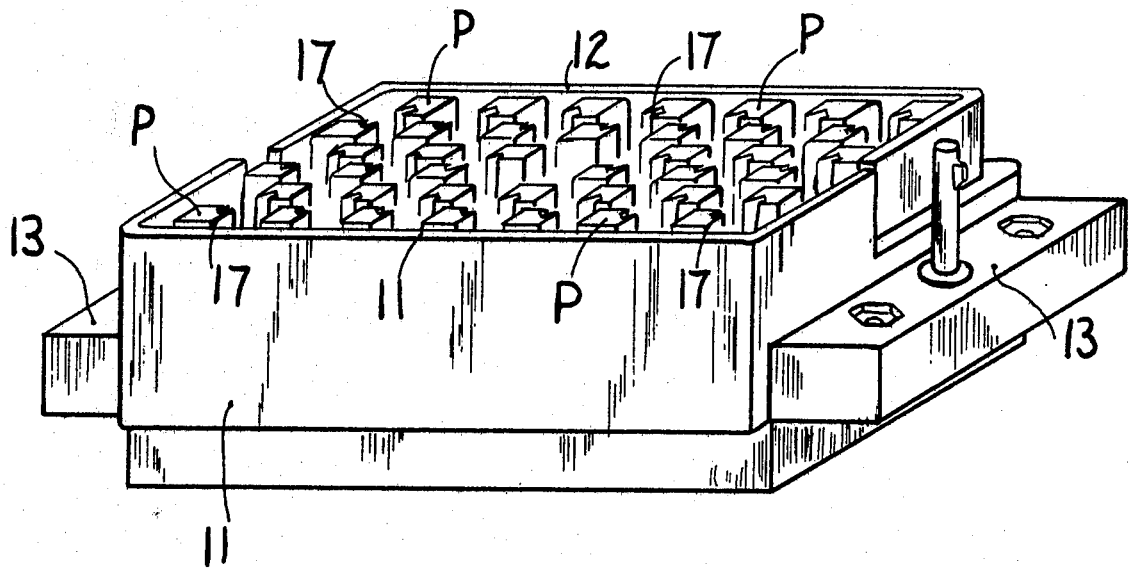
FIG. 1 is a perspective view of one embodiment of the housing according to the present invention.

This invention relates to a hermaphrodite housing assembly for connecting a number of electrical wires, the housing containing a number of contacts which make electrical connections by engaging with contacts of the other housing at right angles.

In order to mate the contacts of this type according to the known art, two housings were prepared. One housing is formed as a socket type with the contacts being embedded in the housing, and the other housing is formed as a plug type with fork portions of the contacts contained in the housing exposed. It is so arranged that when these housings are assembled, fork portions of both housings intersect each other at right angles. With such an assembly, since the contacts of the plug type housing are exposed, not only is there a danger of damage or short-circuiting but also the two housings are required to be accurately aligned. In case of a mis-alignment, there is a danger of excess load being applied to the contact.

In the housing assembly of this type, fork portions of the contacts in the plug type housing are exposed as explained above, so that there is a danger of short-circuiting in addition to the defect that fork portions are liable to be damaged by external forces. Further, special designing of the housings are required in order to assure accurate mating of the plug type housing and the socket type housing. Because of this, the housings must be of different structure which affects adversely the manufacturing cost and efficiency.

The present invention relates to an improvement of the housings of the type explained. The housing is manufactured in one structure, and there are formed a number of projections of rectangular parallelepiped shape or a similar shape standing up from a base of the housing. Slits are formed to adjacent corner portions of the projections and the slits are all formed to run in the same direction, and the contacts are contained in the slits. These housings are shaped so that two housings may be placed oppositely in top and bottom relationship, that is the top of one housing facing the bottom of the other housing. When these housings are mated as mentioned above, the slits of the projections of one housing intersect at right angles the slits of the projections of the other housing. By virtue of this arrangement, the fork portions of the contacts intersect with each other at right angles, with the projections of one housing entering into the spaces between the projections of the other housing and enabling the contacts to be engaged at right angles.

Because of this structure of the housing, the contacts are contained in the insulating projections of the housing and any damage due to external forces and the danger of shortcircuiting between the contacts are prevented. The housings are all manufactured in exactly the same structure which lowers the manufacturing cost while raising the efficiency or production. The projections of one housing enter into spaces between projections of the other housing, so that the assembly obtained by mating two housings is made compact.

Further, in the known housing assembly, contacts in the plug type housing and the contacts in the socket type housing are differently placed, so that if there is any misalignment of contacts in mating the housings, an excess load is applied to the contacts. If this happens, the housings must be re-aligned in order to mate the housings properly. In an assembly according to the present invention, the contacts are all placed in the same manner, so much so that any mis-alignment that may occur in mating the housings will be compensated and the danger of excess load to the contact is eliminated. In order to avoid the damage and danger explained above, it was required of the known housing to be provided with a guide pin and other means for assisting the accurate positioning of the housings. There is no need of such means with the housing of the present invention, and because of this the cost is lowered and the efficiency in production is improved. Further, an assembly work is made easy to raise the efficiency of the work while avoiding any excess load being applied to the contacts.

Moreover, the contacts are contained in the projections of the housing as if the contacts were embedded with no part of the contacts exposed. There is no damage by external forces and the operator's fingers need not touch the contacts, thus keeping the contact surface clean.

A preferred embodiment of the present invention will now be explained with reference being made to the accompanying drawings.

Figure 2:
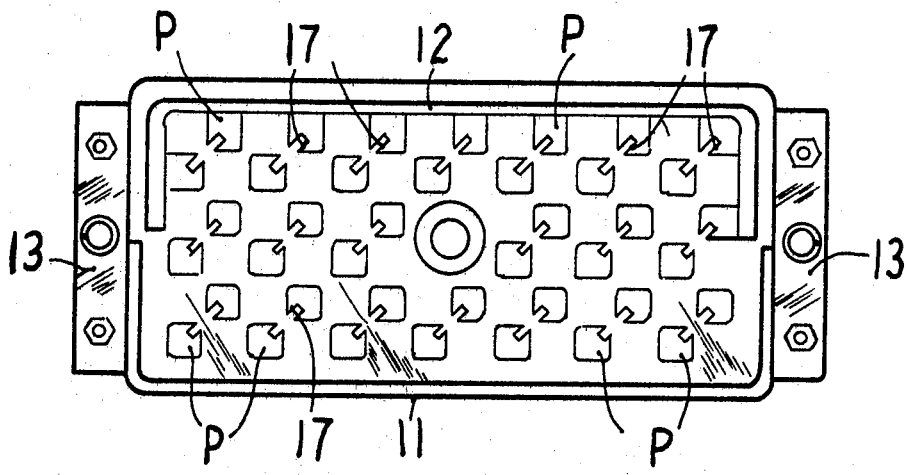
FIG. 2 is a plan view of the housing of FIG. 1.

A housing body shown in FIG. 1 is generally of a rectangular parallelepiped shape and is made of an insulating material such as diallylphthalate, but glass-filled polycarbonate, nylon, polybutylene, terephthalate or noryl may also be used. The housing is formed with a substantially U-shaped outer wall 11 and a similarly U-shaped inner wall 12. The outer wall 11 is formed to the lower half portion of the housing as seen in FIG. 2, so that the outer wall 11 may be regarded as the remaining portion when the upper half portion of an outer wall surrounding the housing is cut off as seen in FIG. 2. The inner wall 12 is formed internally of and opposite the outer wall 11 with a suitable distance being left between the walls. The inner wall 12 may be regarded as the remaining portion when the lower half portion of a wall formed internally of the outer wall is cut off as seen in FIG. 2. The object of forming the outer and inner walls as explained above is to form the housing in one structure and to enable the housings to be mated with each other. For this reason, the outer wall and the inner wall must be complementary. The embodiment of the housing is of substantially a rectangular parallelepiped shape, but since the outer wall and inner wall need only be complementary, the cross-section of the housing may be hexagon or octagon, that is even numbered polygon, or circular or elliptic.

A stop means 13 is provided on the shorter side of the outer wall 11, and a hole or holes are formed to the stop means 13 for a bolt or screw. The size as well as the number of the holes may suitably be selected because the holes are formed for the purpose of mounting the housing to any desired part of a machine or instrument.

The projections P of rectangular parallelepiped shape are formed to stand up from the base portion of the housing. The projections of each row are formed so as to leave the space between the projections to receive a projection of the other housing. The projections of the next row are staggered from the projections of the immediately upper row as seen in FIG. 2. Thus, the projections of each row and column are formed with a space between each other.

Figure 3:
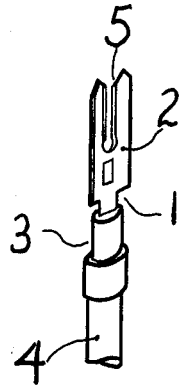
FIG. 3 is a perspective view of a contact to be contained in the housing.

A corner portion of a projection which is diagonally adjacent a corner portion of another projection as seen in FIG. 2 is formed with a slit 17 for receiving a contact of FIG. 3. In FIG. 2, the lower left corners of the projections of the 1st, 3rd, 5th rows and the upper right corners of the projections of the 2nd, 4th, 6th row are provided with the slits 17.

In the FIG. 2 embodiment, projections are represented by P, and the spaces are represented by the state O devoid of the projections. Then, the projections are arranged in FIG. 2 by a matrix shown below:

```
OPOPOPOPOPOPOP
POPOPOPOPOPOPO
OPOPOPOPOPOPOP
POPOPOPOPOPOPO
OPOPOPOPOPOPOP
POPOPOPOPOPOPO
```

In this arrangement, P of the first row is formed with a slit 17 so as to make a pair with P of the 2nd row and the immediately preceding column. In general, P of the nth row and mth column makes a pair with P of the $(n+1)$th row and $(m-1)$th column. Thus, it is understood that the pair of P's may be made by pairing $P(n, m)$ with $P(n+1, m-1)$. In order to prepare as many pairs as possible, P of the 1st row must be paired with P of the 2nd row and the immediately preceding column. P of the 2nd row having been already paired, P of the 3rd row must be paired with P of the 4th row.

Figure 4:
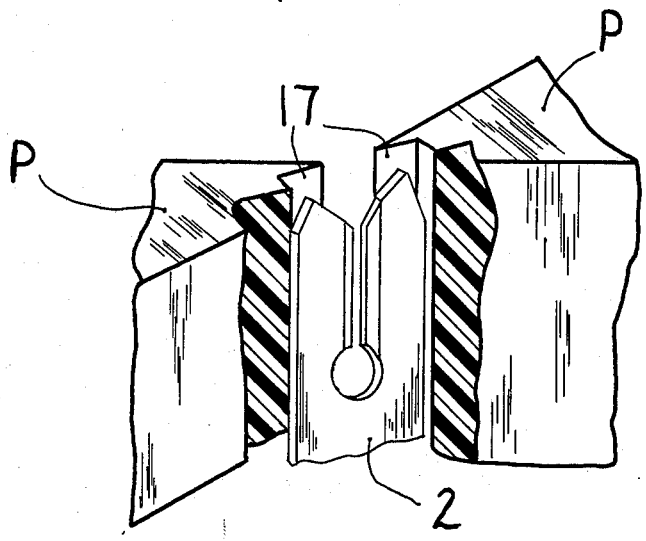
FIG. 4 shows the contact of FIG. 3 contained in the housing.

A contact 1 of FIG. 3 is provided with a fork portion 2 and a part 3 for connection to an electrical wire. A wire 4 is connected to the part 3 by means of caulking or crimping. The fork portion 2 presents a recess 5 which serves the purpose of engaging fork portions of two contacts at right angles. The fork portion 2 of the contact 1 is contained in the slit 17 with the tip of the fork portion 2 reaching the upper end portions of the projections as seen in FIG. 1. FIG. 4 shows the slits 17 of the projection and the fork portion 2 of the contact contained in the slits.

In use, two housings are mated, with one housing in an upside down relationship to the other housing as seen in FIG. 2. Referring to FIG. 2, the outer wall 11 of the other housing is placed to surround the inner wall 12 of the housing of FIG. 2. As explained before, the outer wall 11 and the inner wall 12 are in such a relation that the upper and lower half portions as seen in FIG. 2 are cut off, so that when the two housings are mated, the wall of one housing is contained in the cut-off portion of the other housing in a complementary fashion. Further, projections of one housing enter in spaces of the other housing, and the slits of one housing intersect the slits of the other housing at right angles. By this arrangement, the fork portions of the contacts of one housing engage the fork portions of the contacts of the other housing at right angles, and the connection of the contacts is completed.

In the preferred embodiment, the projections are in a rectangular parallelepiped shape, but the projections may be made in any desired shape so long as the principles of the present invention is preserved. The size of the slits may be determined according to the size of the contacts, but is necessary to be of the size to compensate any mis-alignment of the housings.

What is claimed is:

1. A hermaphrodite housing assembly, the housing being made of an insulation material formed in a substantially rectangular configuration, said housing including, a body portion having a flat base, a first wall, having thickness and extending above said flat base, said first wall aligned with the edge of said flat base and forming one side of said body and half of the sides of said body adjacent to said one side, said flat base abutting the inside of said first wall, a second wall, having thickness and extending above said flat base, said second wall recessed from the edge of said flat base at least the thickness of said first wall and forming the opposite side of said body from said one side and forming half of the sides of said body adjacent to said opposite side, said flat base extending outside the base of said second wall substantially the same distance from said second wall as the thickness of said first wall, said flat base, said first wall and said second wall combining for forming a receptical, first shoulder means extending out from and along one of the sides of said body, in a plane parallel to said flat base, pin means supported by said first shoulder and centrally positioned on said first shoulder and extending above said flat base, second shoulder means extending out from and along the side opposite said one of the sides and said body in plane parallel to said flat base, hole means located in said second shoulder and positioned for receiving and locating said pin means when one housing assembly is mated with another such housing assembly, a plurality of pairs of projections extending from said flat base providing a matrix of projections, one projection of each pair of projections positioned adjacent said second wall abutting said second wall and, one projection of each pair of projections positioned adjacent said first wall displaced from said first wall at least the thickness of said second wall.

2. A hermaphrodite housing assembly as in claim 1 and in which each projection of each pair of projections is off set from the other of the particular pair both laterally and longitudinally by equal amounts and each pair of projections is off set from adjacent pairs of projections both laterally and longitudinally by equal amounts.

3. A hermaphrodite housing assembly as in claim 2 and in which adjacent corners of each projection of each pair of projections include a slot extending into the respective projection, the openings formed by the slots in each pair of projections having a parallel relationship with each other slot in each other pair of projections and the opening formed by slots in one pair of projections is equidistant from the openings formed by the slots in adjacent pairs of projections.

* * * * *